US009343810B2

(12) United States Patent
Chen et al.

(10) Patent No.: US 9,343,810 B2
(45) Date of Patent: May 17, 2016

(54) METHOD OF MAKING AN EXTREMELY LOW PROFILE WIDEBAND ANTENNA

(71) Applicant: Ohio State Innovation Foundation, Columbus, OH (US)

(72) Inventors: Chi-Chih Chen, Dublin, OH (US); Haksu Moon, Columbus, OH (US); John L. Volakis, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 226 days.

(21) Appl. No.: 14/054,943

(22) Filed: Oct. 16, 2013

(65) Prior Publication Data

US 2014/0208582 A1 Jul. 31, 2014

Related U.S. Application Data

(60) Provisional application No. 61/714,494, filed on Oct. 16, 2012.

(51) Int. Cl.
*H01Q 5/00* (2015.01)
*H01Q 7/06* (2006.01)

(52) U.S. Cl.
CPC . *H01Q 5/00* (2013.01); *H01Q 7/06* (2013.01); *Y10T 29/49016* (2015.01)

(58) Field of Classification Search
CPC ..... H01Q 1/00; H01Q 1/288; H01Q 1/36; H01Q 1/364; H01Q 1/38; H01Q 9/065; H01Q 5/00; H01Q 7/06; Y10T 29/49016
See application file for complete search history.

(56) References Cited

U.S. PATENT DOCUMENTS

| | | | | |
|---|---|---|---|---|
| 5,159,347 | A * | 10/1992 | Osterwalder | 343/787 |
| 2007/0132650 | A1 | 6/2007 | Lalezari | |
| 2008/0158083 | A1 | 7/2008 | Apostolos | |
| 2009/0079654 | A1 | 3/2009 | Higaki et al. | |
| 2011/0163936 | A1 | 7/2011 | Schneider et al. | |

OTHER PUBLICATIONS

Andersen, J.B. et al., Antennas for VHF/UHF Personal Radio: A Theoretical and Experimental Study of Characteristics and Performance, IEEE Transactions Vehicular Technology, Nov. 1977, pp. 349-357, vol. 26, No. 4.

Mattioni, L. et al., Design of a Broadband HF Antenna for Multimode Naval Communications—Part II: Extension to VHF/UHF Ranges, IEEE Antennas and Wireless Propagation Letters, 2007, pp. 83-85, vol. 6.

Jahoda, J.R., Development of a JTRS/SINCGARS Ultra-broadband Airborne Blade Antenna, High Frequency Electronics Magazine, Dec. 2006, pp. 83-85.

(Continued)

*Primary Examiner* — Carl Arbes
(74) *Attorney, Agent, or Firm* — Standley Law Group LLP

(57) ABSTRACT

A very low profile wideband antenna adapted to operate from 30 MHz to 300 MHz or in another desired range. The maximum diameter and height of one embodiment of this antenna is only 60.96 cm and 5.08 cm, respectively. This design is comprised of a fat grounded metallic plate placed 5.08 cm over a ground plane. In one embodiment, ferrite loading strategically placed between the plate and ground plane improves the low frequency gain and the pattern at high frequencies. A minimal amount of ferrite may be used to keep weight low.

21 Claims, 6 Drawing Sheets

(56) References Cited

OTHER PUBLICATIONS

Vinvoy, K.J. et al., Hilbert Curve Fractal Antenna: A Small Resonant Antenna for VHF/UHF Applications, Microwave and Optical Technology Letters, May 2001, pp. 215-219, vol. 29, No. 4.

Agrawall, N.P. et al., Wide-band Planar Monopole Antennas, IEEE Transactions Antennas and Propogation, Feb. 1998, pp. 294-295, vol. 46, No. 2.

Ammann, M.J. et al., Wideband Monopole Antennas for Multi-Band Wireless Systems, IEEE Antennas and Propagation Magazine, Apr. 2003, pp. 146-150, vol. 45, No. 2.

Antonino-Daviu, E. et al., Wideband Double-Fed Planar Monopole Antennas, Electronics Letters, Nov. 2003, pp. 1635-1636, vol. 39, No. 2.

Lapierre, M. et al., Ultra Wideband Monopole/Dielectric Resonator Antenna, IEEE Microwave and Wireless Components Letters, Jan. 2005, pp. 7-9, vol. 15, No. 1.

Lee, J.W. et al., A New Vertical Half Disc-Loaded Ultra-Wideband Monopole Antenna (VHDMA) With a Horizontally Top-Loaded Small Disc, IEEE Antennas and Wireless Propagation Letters, 2005, pp. 198-201, vol. 4.

McVay, J. et al., Miniaturization of Top-Loaded Monopole Antennas Using Peano-Curves, 2007 IEEE Radio and Wireless Symposium, Jan. 2007, pp. 253-256.

Gonzalez-Arbesu, J.M. et al., The Hilbert Curve as a Small Self-Resonant Monopole From a Practical Point of View, Microwave and Optical Technology Letters, Oct. 2003, pp. 45-49, vol. 39, Issue 1.

Zhao, J. et al., Frequency-Scaled UWB Inverted-Hat Antenna, IEEE Transactions on Antennas and Propagation, Jul. 2010, pp. 2447-2451, vol. 58, No. 7.

Zhao, J. et al., Low-Profile Ultra-Wideband Inverted-Hat Monopole Antenna for 50MHz-2GHz Operation, Electronics Letters, Jan. 2009, pp. 142-144, vol. 45, Issue 3.

Fante, R.L., Quality Factor of General Ideal Antennas, IEEE Transactions on Antennas and Propagation, Mar. 1969, pp. 151-155, vol. 17, Issue 2.

Yaghjian, A.D. et al., Impedance, Bandwith, and Q of Antennas, IEEE Transactions on Antennas and Propagation, Apr. 2005, pp. 1298-1324, vol. 53, No. 4.

Thal, H.L., New Radiation Q Limits for Spherical Wire Antennas, IEEE Transactions on Antennas and Propagation, Oct. 2006, pp. 2757-2763, vol. 54, No. 10.

Chu, L.J., Physical Limitations of Omni-Directional Antennas, Journal of Applied Physics, Dec. 1948, pp. 1163-1175, vol. 19, Issue 12.

Panashield Inc. [Online]. Available: http://www. panashield.com.

* cited by examiner

METHOD OF MAKING AN EXTREMELY LOW PROFILE WIDEBAND ANTENNA

This application claims the benefit of U.S. Provisional Application No. 61/714,494, filed Oct. 16, 2012, which is hereby incorporated by reference in its entirety.

STATEMENT REGARDING FEDERALLY SPONSORED RESEARCH OR DEVELOPMENT

This invention was made with government support awarded by the US Naval Air Systems Command (NAVAIR). The government has certain rights in the invention.

BACKGROUND AND SUMMARY OF THE INVENTION

Exemplary embodiments of the present invention relate generally to an antenna and a method for designing an antenna. Exemplary embodiments may be particularly adapted to operate in the VHF frequency range, more particularly from 30 to 300 MHz. Other exemplary embodiments may be adapted to operate in other frequency ranges not limited to VHF, unless otherwise specified.

VHF antennas operating over the frequency range of 30-3000 MHz are widely used for short-distance terrestrial communications such as TV broadcast, amateur radio, land mobile and marine communications, air traffic control communications, and air navigation systems. Monopole antennas are most commonly used for VHF/UHF communications. However, monopoles require a quarter wavelength height and have narrow bandwidth. The known art has discussed the performance of small monopole VHF/UHF antennas for personal radios. There are also known designs for increasing the bandwidth of monopole antennas. However, these designs still require significant antenna heights. Furthermore, the known art has also discussed relatively smaller monopoles via meandering. But these monopoles do not have wide bandwidth. Recently, the known art presented wideband monopoles for VHF-UHF operations from 20 to 2000 MHz with a height of 15.24 cm and peak gain of approximately −25 dBi at 20 MHz. However, these known designs produce monopole-type patterns with a null in the direction normal to the ground plane.

In sum, known attempts to miniaturize antenna volume has resulted in an unsatisfactory tradeoff between radiation quality Q and bandwidth. For instance, dielectric loading of TM-mode radiators (such as dipoles and monopoles) leads to bandwidth reduction. On the other hand, magnetic loading of TE-mode radiators, as is the case with loop antennas, can only achieve minimum radiation Q. In such embodiments, the energy stored within the loop antenna is mainly magnetic. As a result, by loading the loop with high permeability material, less of the stored energy is near the antenna volume, implying a lower Q.

In light of these shortcomings, there is a need for a VHF antenna design with extremely small dimensions, including a low height, diameter, and/or weight. There is also a need for an antenna design adapted to operate in a defined frequency range, most preferably 30 to 300 MHz. A further need exists for an antenna design that does not exhibit monopole type patterns. An antenna design with an extremely low height of 5.08 cm operating from 30 to 300 MHz is not known to exist. There is also a need for an antenna with reduced volume to have improved Q and bandwidth performance.

An exemplary embodiment of the present invention may satisfy one or more of these needs. One exemplary embodiment provides an antenna design comprised of a conductive plate that is connected to a ground plane. A ferrite load is positioned between the conductive plate and the ground plane. An example of the antenna design may have a low profile and weight. An exemplary embodiment may also provide improved gain, radiation pattern, radiation quality, and bandwidth performance. One example of an antenna design may be adapted to operate from 30 to 300 MHz and have a diameter of 60.96 cm or less and a height of 5.08 cm or less, although other embodiments may have other dimensions and/or be adapted to operate over other frequency ranges.

In addition to the novel features and advantages mentioned above, other benefits will be readily apparent from the following descriptions of the drawings and exemplary embodiments.

BRIEF DESCRIPTION OF THE DRAWINGS

FIG. 2(*b*) is a graph of an example of a parametric study of the unloaded half-loop antenna of FIG. 1 when placed on an infinite ground plane, where gain dependence on height (e.g., L=43.18 cm) is shown.

FIG. 4(*b*) shows side elevation and perspective views of an exemplary embodiment of an antenna having an example of a ferrite loading configuration comprising a 5.08 cm thick uniform ferrite coating. Dimensions are provided for purposes of example.

FIG. 4(*c*) shows side elevation and perspective views of an exemplary embodiment of an antenna having an example of a ferrite loading configuration comprising a 2.54 cm thick uniform ferrite coating. Dimensions are provided for purposes of example.

FIG. 4(*d*) shows side elevation and perspective views of an exemplary embodiment of an antenna having an example of a ferrite loading configuration comprising a tapered ferrite coating.

FIG. 4(*e*) is a graph of an example of reactance curves corresponding to the exemplary embodiments of antennas shown in FIG. 4(*a*)-4(*d*).

FIG. 5(*b*) is a side elevation view of an example of a weight-reduced ferrite loading configuration. Dimensions are provided for purposes of example.

FIG. 8(*b*) is a perspective view of an exemplary embodiment of an antenna, with a radome and spacing foam removed for clarity. Dimensions are provided for purposes of example.

FIG. 8(*c*) is a perspective view of the antenna of FIG. 8(*b*) shown enclosed in a radome. Dimensions are provided for purposes of example.

FIG. 9(*b*) is a graph showing a comparison of examples of measured (solid lines with respect to the exemplary embodiment shown in FIG. 8(*c*)) and simulated (dashed lines with respect to the exemplary embodiment shown in FIG. 5(*b*)) realized gain along the x-axis.

DETAILED DESCRIPTION OF EXEMPLARY EMBODIMENT(S)

Figure 1:
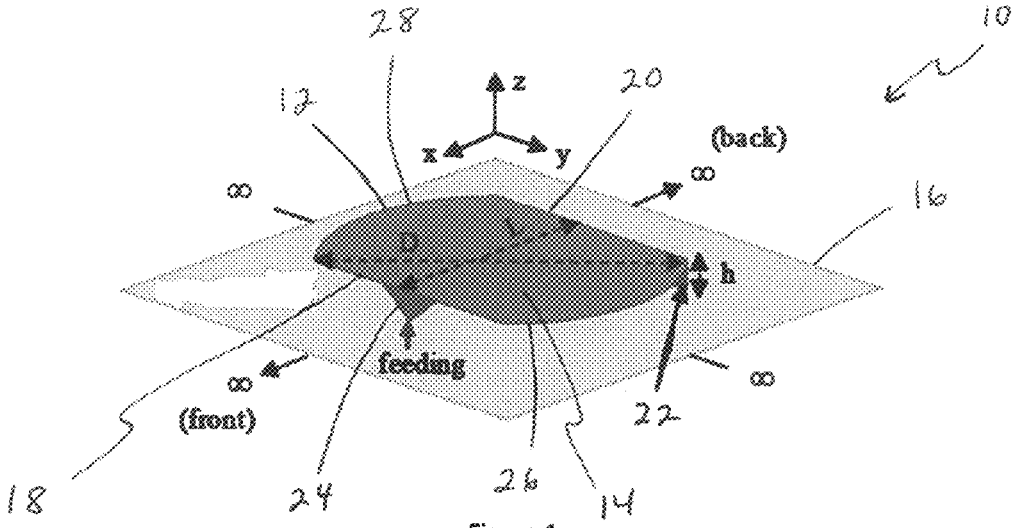
FIG. 1 is a perspective view of an exemplary embodiment of geometry of a grounded half-loop antenna of the present invention on an infinite PEC ground plane.

Exemplary embodiments of the present invention are directed to an antenna and a related method for its design. One example is related to a low profile antenna design 10 as shown in FIG. 1 that is specifically adapted to operate in the VHF range of 30-300 MHz. In particular, this exemplary embodiment of an antenna design has a conductive plate 12 with a top portion 14 having diameter (D) of 60.96 cm and a height (h) of 5.08 cm above a potentially infinite and substantially perfect electrical conducting (PEC) ground plane 16. However, other exemplary embodiments of the present invention may be adapted to operate in ranges that are not limited to VHF. Also, other exemplary embodiments may have smaller dimensions (e.g., a height of 5.08 cm or less or a diameter of 60.96 cm or less) or, alternatively, may have larger dimensions. Furthermore, exemplary embodiments may be implemented with a ground plane and a conductive plate (i.e., top plate) comprised of any suitable conductive materials (e.g., metals), which may not be substantially perfect electrical conductors.

Table 1 shows the electrical dimension of the exemplary antenna at several frequencies, where $k=2\pi/\lambda$ is the wave number in free space and "a" is the radius of the smallest sphere enclosing the antenna structure excluding the infinite ground plane for determining a radiation quality factor Q. While this embodiment considers an infinite ground plane, an otherwise wide ground plane (e.g., if mounted on a platform) will typically lead to better performance. However, other exemplary embodiments may implement a ground plane that is relatively small compared to the known art and still achieve desirable results.

TABLE 1

ELECTRICAL DIMENSION OF AN EXEMPLARY ANTENNA

| Frequency | Height (5.08 cm) | Diameter (60.96 cm) | ka |
|---|---|---|---|
| 30 MHz | λ/200 | λ/16 | 0.194 |
| 155 MHz | λ/38 | 3λ/10 | 1 |
| 300 MHz | λ/20 | 3λ/5 | 1.943 |

In an exemplary embodiment, a design comprising ferrite loading of the antenna may provide particularly beneficial results as compared to an unloaded design. For instance, as will be explained in more detail below, one example of ferrite loading led to a gain improvement of 12.3 dBi at 30 MHz and more stable gain above 100 MHz. In this example, while the gain is more stable over 100 MHz, there may be some gain reduction in the 100-250 MHz band such as may result from magnetic losses in the ferrite as compared to an unloaded design. As a result, some embodiments of an antenna design may not include ferrite loading to achieve desired gain patterns in a particular frequency range, or some embodiments may select ferrite loading having different permittivity, permeability, intrinsic loss characteristics, and/or other dielectric characteristics to achieve desired results over a frequency range not limited to VHF. In light of these considerations, examples of ferrite loading and a strategy for reducing the weight of ferrite loading are addressed below. Measurement data for exemplary embodiments of antennas are also provided to further illustrate the considerations.

One exemplary embodiment is a wideband grounded half-loop antenna. However, the design considerations discussed herein may be applied to other types of antennas. Regardless of type, antenna miniaturization may be achieved using dielectric ($\in r$) and/or magnetic ($\mu r$) material loading, while at the same time achieving improved Q and bandwidth performance. These considerations are the motivation for a ferrite-loaded grounded half-loop antenna of an exemplary embodiment.

The geometry of an exemplary embodiment of an unloaded grounded half-loop antenna 10 is shown in FIG. 1. In this example, top portion 14 is comprised of conductive material (e.g., metal) and is 5.08 cm (h) above ground plane 16 and may be cut from a D=60.96 cm circular plate such that its short dimension between a first side 18 and a second side 20, which oppose each other and are substantially parallel, is L=43.18 cm. In other embodiments, any of the dimensions may be different (e.g., less or more). In this example, one of the sides is connected (i.e., shorted) to ground to form the loop and the other is connected (i.e., placed in electrical communication) or adapted to be connected to an antenna feed (e.g., to the center conductor of an N-type connector feed). In this example, a small, substantially right-angle, vertical, triangular strip or end (i.e., ends 22 and 24, respectively) extends from each of sides 18 and 20, respectively, of top portion 14 to facilitate each of these connections. As a result, top portion 14 is elevated above ground plane 16. The other opposing sides 26 and 28 of top portion 14 of this exemplary embodiment are respectively formed by an arc of the aforementioned circular plate.

While this example provides particularly beneficial results, a top portion or ends may have various other shapes and dimensions and still perform the aforementioned functions. For example, a top portion may be rectangular, elliptical, circular, polygonal, curved, or any other suitable shape to achieve desired performance characteristics (e.g., gain, bandwidth, radiation pattern, radiation quality, and/or weight). Similarly, opposing sides may not be parallel in some exemplary embodiments, or the ends may have different shapes, extend from different portions of a top portion, or extend at different angles or no angle (e.g., a smooth dome configuration) from a top portion. In addition, while the extremely small dimensions may be particular beneficial for many applications including but not limited to, mounting on an aircraft to limit aerodynamic drag, other embodiments may have even smaller or larger dimensions. Also, some embodiments may not be cut from a conductive plate and instead may be cast or otherwise formed in a desired shape. Other variations may be possible and still fall within the scope of the present invention.

Figure 2A:
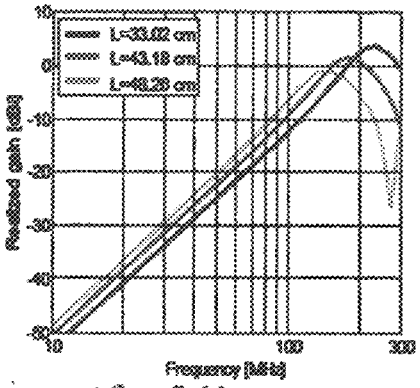
FIG. 2(*a*) is a graph of an example of a parametric study of the unloaded half-loop antenna of FIG. 1 when placed on an infinite ground plane, where gain dependence on length (e.g., h=5.08 cm) is shown.
Figure 2B:
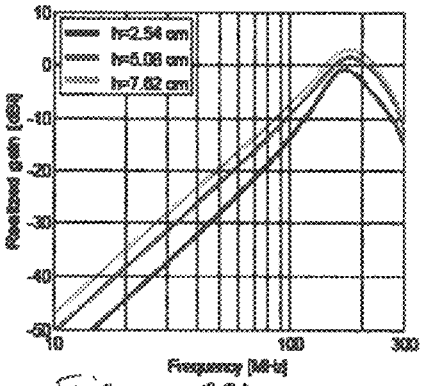

FIGS. 2(*a*) and 2(*b*) plot examples of a reference (unloaded antenna) realized gain along the x-axis (front direction in FIG. 1) for different combinations of lengths (L) and heights (h). In this example, FIG. 2(*a*) shows that the resonant frequency occurs when L+h~λ/4, i.e., 155 MHz for L=43.18 cm. Above the resonant frequency, the gain drops sharply when L~λ2 in this embodiment, where reflection from the shorting walls causes field cancellation. FIG. 2(*b*) shows that the gain at low frequencies in this example is more affected by the height (h) and less so by the length (L) of the plate. Nonetheless, length (L) is significant to bandwidth performance (e.g., a wider top plate may facilitate wider bandwidth operation). Below, this example of the antenna geometry of L=43.18 cm, D=60.96 cm, and h=5.08 cm was used and modified with magnetic loading for purposes of illustration.

Figure 3:
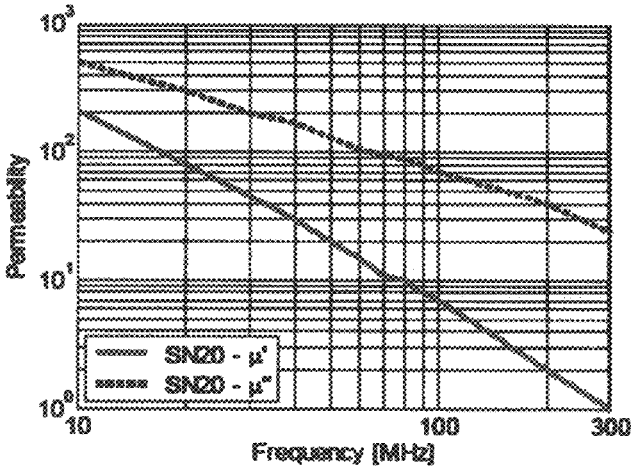
FIG. 3 is a graph of magnetic properties of an example of ferrite that may be used for antenna loading.

In particular, ferrite loading may be used to achieve miniaturization of the antenna. In an exemplary embodiment, a ground plane, ferrite loading, and a conductive plate may be associated such that the ferrite loading is positioned between the ground plane and the conductive plate. In this exemplary embodiment, to further improve gain below 100 MHz, a high-permeability ferrite slab was placed between the plate and the ground plane. Specifically, in this example, a commercial SN-20 ferrite material by Panashield Inc. was utilized. The magnetic properties of the exemplary SN-20 ferrite are shown in FIG. 3, and its dielectric constant is approximated as ∈r=12. It should be noted that loss in this material suppresses resonant modes within the ferrite slabs. In this embodiment, this is important as such modes will produce multi-band performance and compromise continuous wideband operations. Nevertheless, since the permeability in the 100-300 MHz range is not as high as compared to the permittivity, the ferrite's impedance is lowered. Therefore, it behaves more like an absorber in that band, implying lower gain at lower frequencies. Ideally, in some other exemplary embodiments, it may be desirable to use a high permeability ferrite material with very low losses, if such material is available. Such high permeability material, particularly in combination with a half-loop design, may also facilitate wider bandwidth performance. Other types of ferrite having different permittivity, permeability, intrinsic loss characteristics, and/or other dielectric characteristics may also be used. For example, other types of ferrite having permeability substantially higher than the permittivity may be used. In addition, other types of magnetic material may be used in some other exemplary embodiments.

Figure 4A:
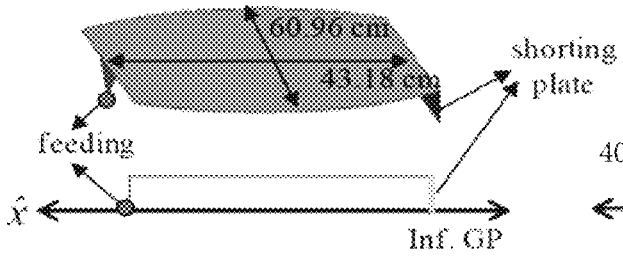
FIG. 4(*a*) shows side elevation and perspective views of an exemplary embodiment of an unloaded antenna configuration. Dimensions are provided for purposes of example.
Figure 4:
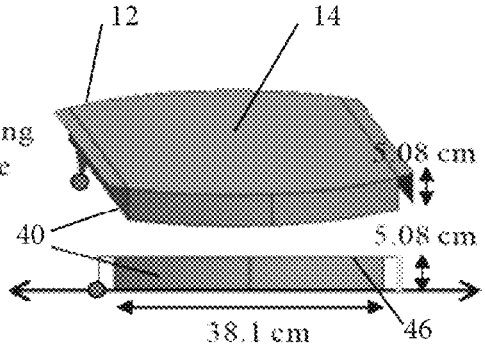
Figure 4:
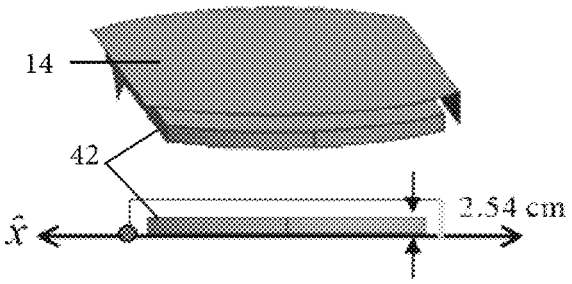
Figure 4:
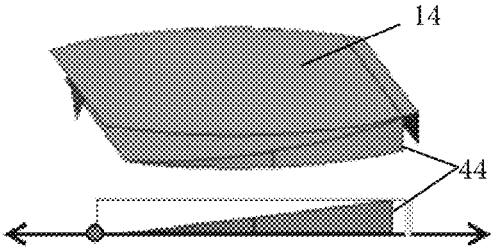
Figure 4:
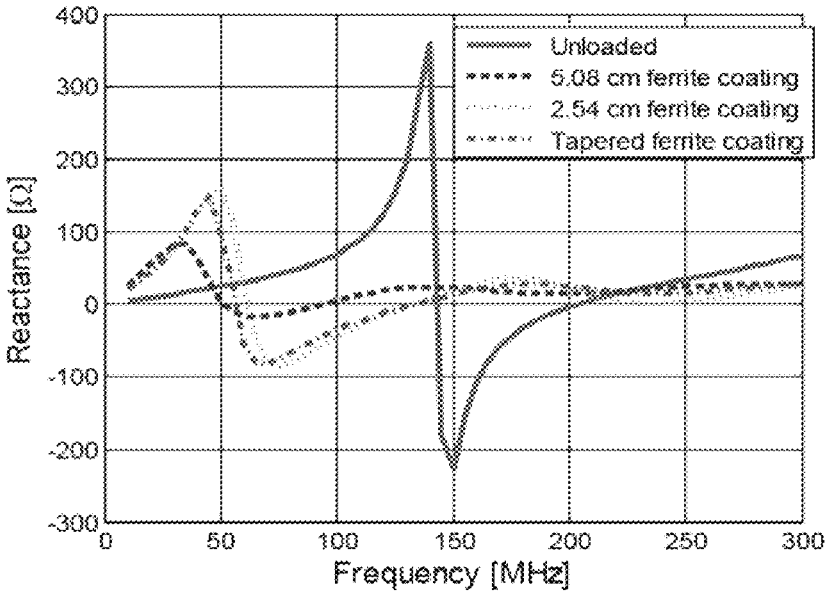

FIGS. 4(*a*)-4(*e*) demonstrate examples of the miniaturization effect (e.g., using the SN-20 ferrite loading) by observing the zero-crossing frequency of the reactance (as shown FIG. 4(*e*)) for different ferrite loadings (as shown in FIGS. 4(*a*)-4(*d*)). In FIGS. 4(*b*) and 4(*c*), the ferrite loading 40 and 42, respectively, has substantially uniform length, width, and height, whereas the ferrite loading 44 has a tapered height in FIG. 4(*d*). In FIG. 4(*b*), the ferrite loading 40 contacts the underside 46 of top portion 14 of the conductive plate 12. However, in other exemplary embodiments (e.g., such as shown in the examples of FIGS. 4(*c*) and 4(*d*)), there may be a space between the top plate 14 and the ferrite loading. With respect to these examples, it can be seen that a larger ferrite volume produces more miniaturization. Referring to FIGS. 4(*c*) and (*d*), it was noted that although the loadings 42 and 44 have different geometries, they have the same volume and produced similar miniaturization.

Figure 5:
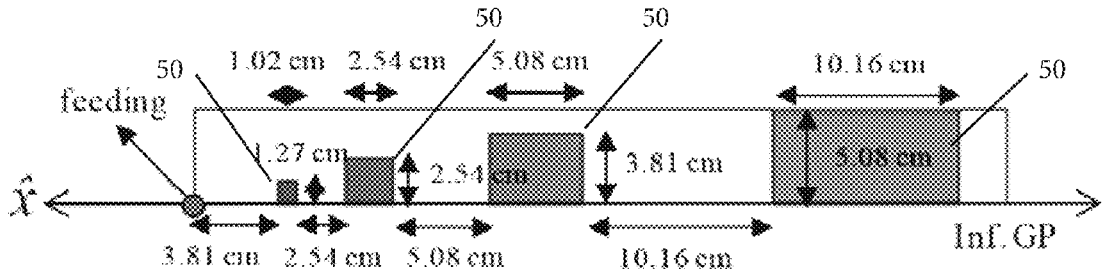
FIG. 5(*a*) is a side elevation view of one example of an optimized ferrite loading configuration. Dimensions are provided for purposes of example.
Figure 5:
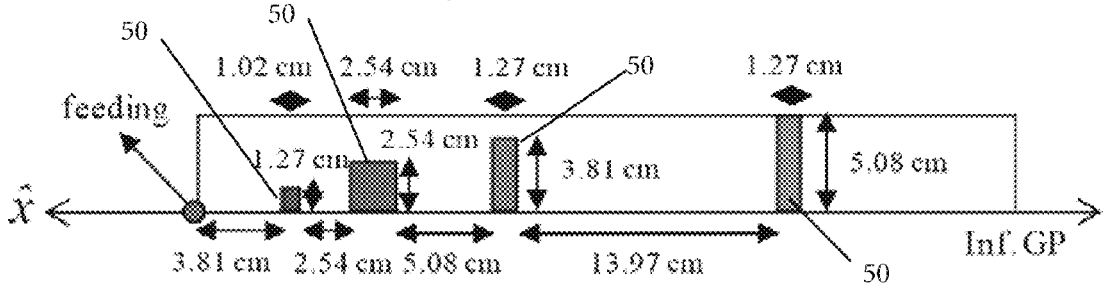

In view of these findings, steps may be taken to further optimize the ferrite loading. In particular, although ferrites are particularly effective in improving radiation at lower frequencies, they are typically heavy. Thus, as shown above, the volume of the loading may be minimized to maintain antenna performance at higher frequencies due to their high density and high loss. Through extensive study, it was determined that an exemplary embodiment of four ferrite bars 50 of different heights and widths (see FIGS. 5(*a*) and 5(*b*)) provided a good compromise between bandwidth and weight. Other embodiments may use a different number, configuration, size(s), or shape(s) of bars or other portions of loading material, such as to suitably operate with a particular size, shape, or configuration of a top conductive plate. For this embodiment, an example of an optimal loading configuration is depicted in FIG. 5(*a*). In particular, in this example, each of the bars 50 has a different height and width. In other embodiments (e.g., such as shown in FIG. 5(*b*)), some or all of the bars may have a common height and/or width.

Figure 6:
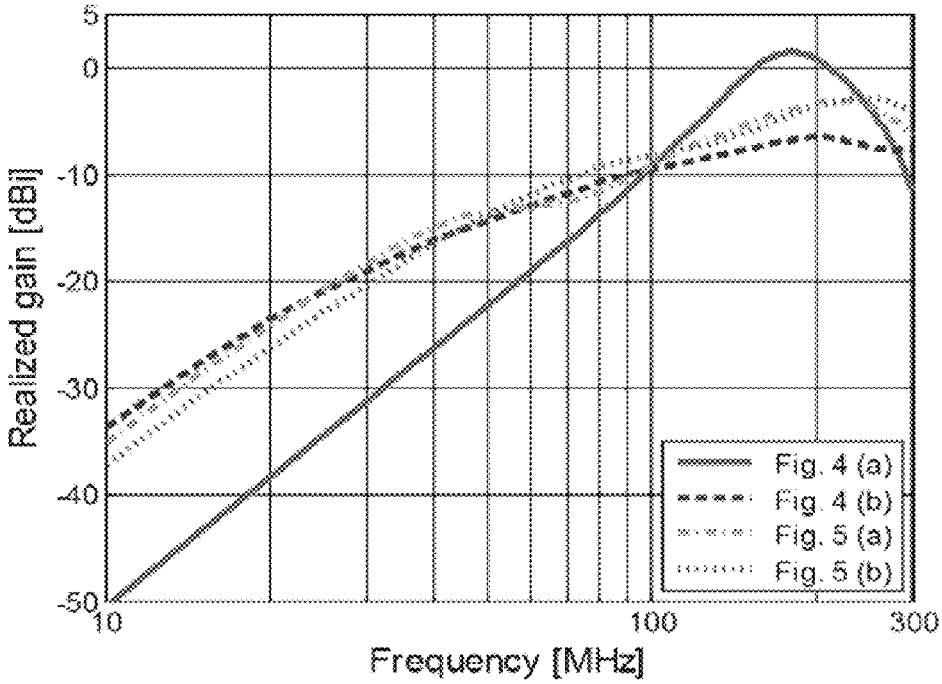
FIG. 6 is a graph of an example of realized gain of the weight-reduced ferrite-loaded half-loop antenna of FIG. 5(*b*) as compared to the optimized ferrite loaded configuration of FIG. 5(*a*) and the other configurations of FIGS. 4(*a*) and 4(*b*).

FIG. 6 compares the corresponding realized gain along the x-axis for the exemplary embodiments shown in FIGS. 4(*a*), 4(*b*), 5(*a*), and 5(*b*). As shown, the unloaded case of FIG. 4(*a*) has low gain −31.4 dBi at 30 MHz. In contrast, the fully loaded case of FIG. 4(*b*) shows a gain improvement of 12.3 dBi over the unloaded one. However, in this example, the fully loaded case provides lower gain at higher frequencies (above 100 MHz due to ferrite losses). In this respect, as shown in FIG. 6, the exemplary optimized loading case of FIG. 5(*a*) shows better performance than the exemplary fully loaded case (FIG. 4(*b*)) with −18.4 dBi gain at 30 MHz.

Figure 7:
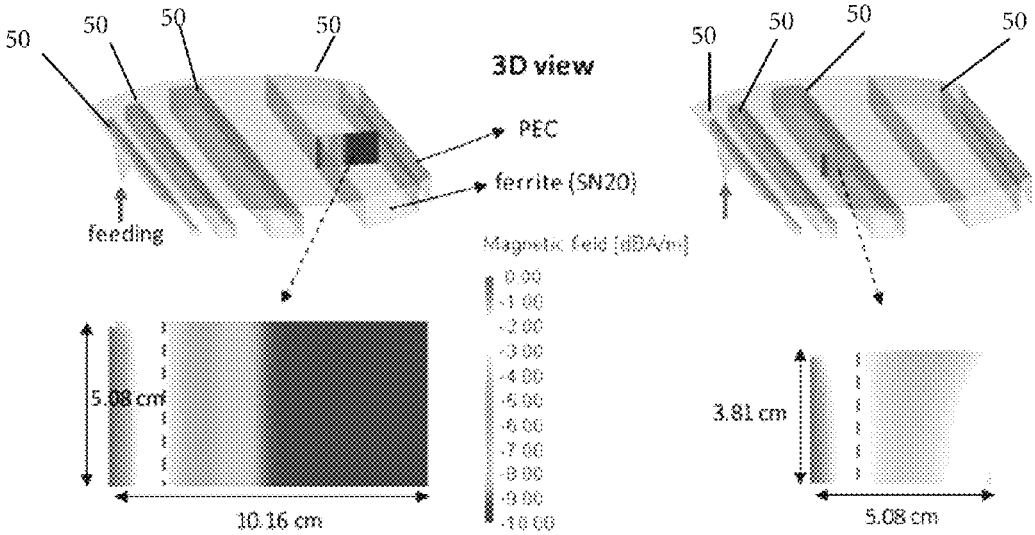
FIG. 7 shows various views of examples of normalized magnetic field distribution in the two largest ferrite bars of FIG. 5(*a*) at 30 MHz. Dimensions are provided for purposes of example.

In this example, the total weight for the configuration in FIG. 5(*a*) was 21.32 kg, which may be considered heavy. To further reduce the weight without significant gain compromise, the inventors examined the magnetic field within the ferrite bars 50 (such as shown in FIG. 7). In this exemplary embodiment, it was observed that the field magnitude rapidly decays after it enters the ferrite. Therefore, in this exemplary embodiment, the widths of the two largest ferrite bars 50 were reduced as shown in FIG. 5(*b*) without significantly impacting antenna performance. In particular, in this example, a first ferrite bar 50 has a width of 1.27 cm or less and a height of 5.08 cm or less; a second ferrite bar 50 has a width of 1.27 cm or less and a height of 3.81 cm or less; a third ferrite bar 50 has a width of 2.54 cm or less and a height of 2.54 cm or less; and a fourth ferrite bar 50 has a width of 1.02 cm or less and a height of 1.27 cm or less. As a result, the weight was then reduced to acceptable 9.07 kg in this example. The gain curve for this 9.07 kg configuration is shown in FIG. 6. In this example, there was only a 2 dBi gain reduction at 30 MHz, and the antenna retains the gain of the fully loaded case above 55 MHz. In light of these findings, it should be recognized that different loading configurations or materials may exhibit different results. Likewise, the designs and materials used for the top plate and ground will also affect performance characteristics.

Figure 8:
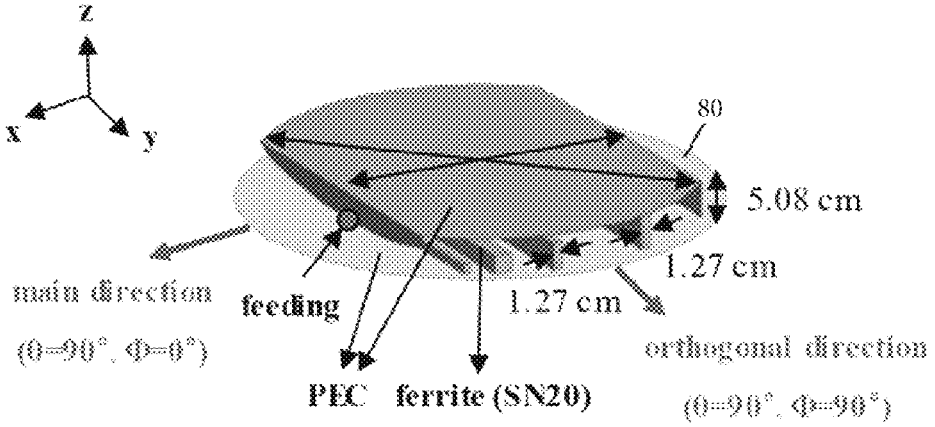
FIG. 8(*a*) is a perspective view of an exemplary embodiment of an antenna. Dimensions are provided for purposes of example.
Figure 8:
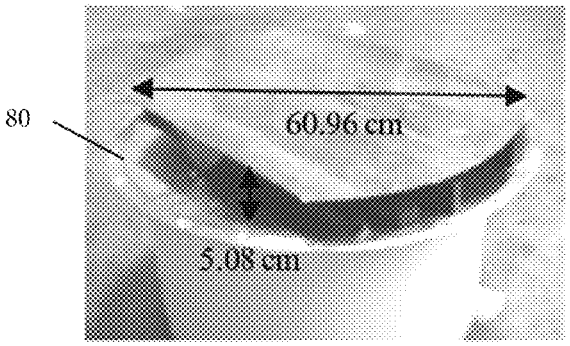
Figure 8:
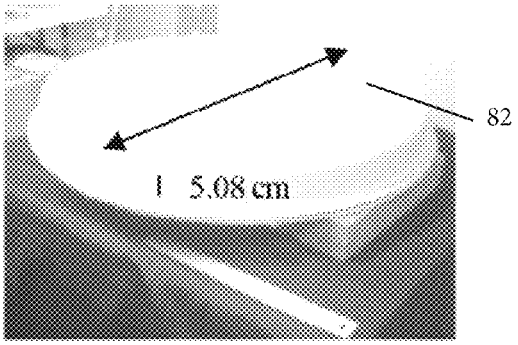

The design shown in FIG. 5(*b*) was used for an exemplary embodiment of a VHF wideband antenna and was fabricated on a 66.04 cm diameter aluminum plate 80 as shown in FIGS. 8(*a*) and 8(*b*). Such as shown in FIG. 8(*c*), a radome 82 was included as well, and empty space in the antenna may be filled with foam for mechanical stability. The assembled antenna with the radome 82 of FIG. 8(*c*) was tested at an outdoor range to measure its realized gain, patterns, and VSWR.

Figure 9:
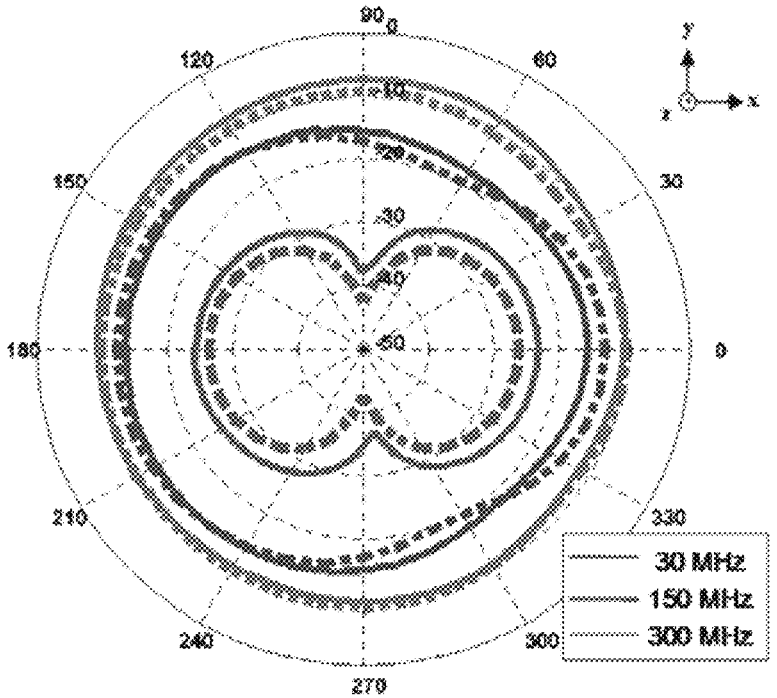
FIG. 9(*a*) is a graph showing a comparison of examples of measured (solid lines with respect to the exemplary embodiment shown in FIG. 8(*c*)) and simulated (dashed lines with respect to the exemplary embodiment shown in FIG. 5(*b*)) horizontal antenna gain patterns in the xy-plane.
Figure 9:
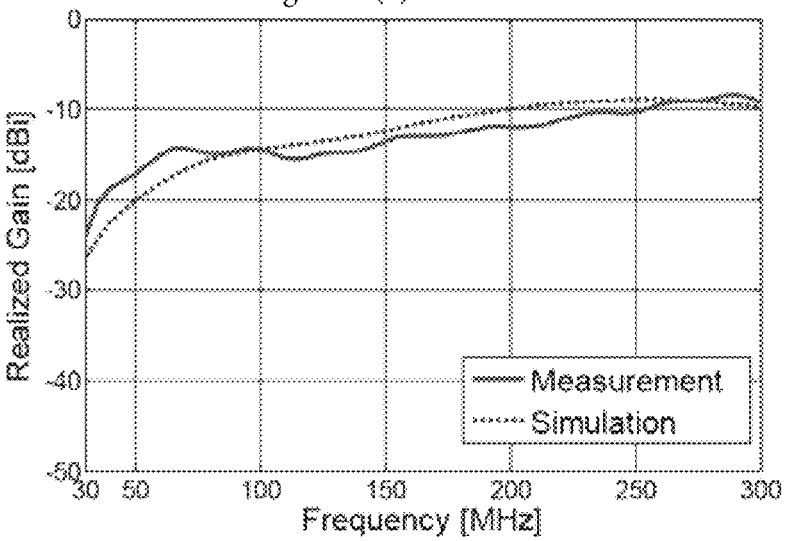
Figure 10:
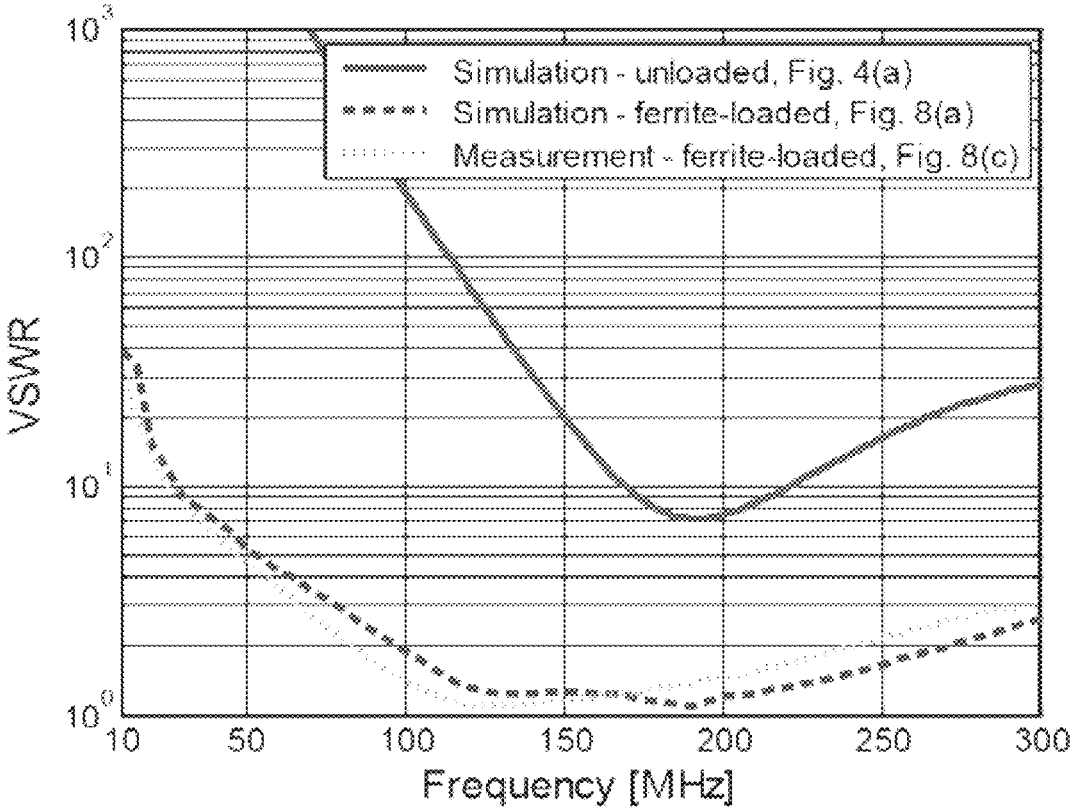
FIG. 10 is a graph showing a comparison of examples of measured (with respect to the exemplary embodiment shown in FIG. 8(*c*)) and simulated (with respect to the exemplary embodiments shown in FIGS. 4(*a*) and 8(*a*)) VSWR.

For this example, the measured results are compared with simulations in FIG. 9 and FIG. 10 (patterns are given at 30, 150, and 300 MHz). Such as shown, the measured patterns agreed well with simulations. Although the gain drops in the orthogonal direction (y-direction) at the low frequency end in this exemplary embodiment due to cancellation from the two side apertures, omni-directional patterns may be obtained when, for example, the antenna is mounted on a cylindrical surface such as an aircraft fuselage with the feed facing towards the nose or tail. In this example, the measured gain along the x-axis is slightly higher than that from simulations below 70 MHz and slightly below simulations above 120 MHz. This is probably due to the difference in the permittivity and permeability used in modeling the ferrite bars.

For this exemplary embodiment, the measured and simulated voltage standing wave ratio (VSWR) data on a finite 66.04 cm ground plane agree well (see FIG. 10). Other embodiments may have a smaller ground plane or a ground plane with a different shape and still adequately perform. Also, other embodiments may have a larger ground plane (e.g., if mounted on a platform). Importantly, this example of VSWR is much lower than the case without ferrite loading (see FIG. 4(*a*)). This may be particularly desirable as reflections to the transmitter are reduced. Such VSWR reduction is primarily due to better impedance matching, but may be somewhat at the expense of antenna efficiency. Again, in light of the design considerations discussed herein, different materials and configurations may lead to different results.

Thus, for one example, a novel and extremely low profile (5.08 cm thick) VHF antenna was developed, fabricated, and tested for continuous operation from 30 to 300 MHz without drop-out bands. In comparison, known legacy broadband blade VHF antennas may have a height as high as 37.2 cm and weight of 1.6 kg. The current example of a novel antenna is 7.4 times lower in height, but may only be 5.7 times heavier due to the employed ferrite. Importantly, this exemplary embodiment of an antenna produces a broad hemispherical pattern with a peak gain of −22 dBi at 30 MHz, −15 dBi at 70 MHz, and −9 dBi at 300 MHz. Such performance is quite satisfactory for most intended applications. In this example, the gain is stable but not high in the 100-300 MHz range due to magnetic losses in the chosen ferrite. By using ferrites having different characteristics (e.g., lower intrinsic losses), an exemplary embodiment may achieve different results over the 100-300 MHz range or any other range (e.g., substantially monotonic gain increasing from about −15 dBi at 70 MHz to about +3 dBi at 300 MHz).

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A method for designing an ultra low-profile VHF antenna, said method comprising:

providing a ground plane;

providing a ferrite loading;

providing a conductive plate having a first end and a second end; and associating said ground plane, said ferrite loading, and said conductive plate such that said ferrite loading is positioned between said ground plane and said conductive plate, said first end of said conductive plate is shorted to said ground plane, and said second end of said conductive plate is adapted to be placed in electrical communication with an antenna feed.

2. The method of claim 1 wherein said ground plane and said conductive plate are comprised of metallic material.

3. The method of claim 1 wherein said ground plane is comprised of a plate that has a diameter of 66.04 cm or less.

4. The method of claim 1, wherein said ferrite loading is comprised of ferrite having permeability substantially higher than the permittivity.

5. The method of claim 1, wherein said ferrite loading is comprised of a plurality of ferrite bars.

6. The method of claim 5 further comprising a step of optimizing a height and a width of each ferrite bar for chosen bandwidth.

7. The method of claim 6 wherein said ferrite loading comprises:

a first ferrite bar that has a width of 1.27 cm or less and a height of 5.08 cm or less;

a second ferrite bar that has a width of 1.27 cm or less and a height of 3.81 cm or less;

a third ferrite bar that has a width of 2.54 cm or less and a height of 2.54 cm or less; and a fourth ferrite bar that has a width of 1.02 cm or less and a height of 1.27 cm or less.

8. The method of claim 1 wherein said ferrite loading has substantially uniform length, width, and height.

9. The method of claim 1 wherein said ferrite loading has a tapered height.

10. The method of claim 1 wherein said ferrite loading is positioned between said ground plane and said conductive plate such that there is space there between.

11. The method of claim 1 wherein a top portion of said conductive plate is 5.08 cm or less above said ground plane.

12. The method of claim 1 wherein:

said conductive plate is comprised of a top portion comprising first side, a second side, a third side, and a fourth side;

said first side and said second side opposing each other; and said third side and said fourth side opposing each other, each of said third side and said fourth side comprised of an arc of an imaginary circle;

wherein said first end extends from said first side and said second end extends from said second side.

13. The method of claim 12 wherein the step of providing a conductive plate comprises steps for:

providing a circular plate comprised of conductive material; and cutting said first side and said second side from said circular plate.

14. The method of claim 12 wherein said first side is substantially parallel to said second side.

15. The method of claim 12 where a distance between said first side and said second side is 43.18 cm or less.

16. The method of claim 12 wherein said imaginary circle has a diameter of 60.96 cm or less.

17. The method of claim 1 wherein:

said first end is a substantially triangular strip that extends from a top portion of said conductive plate at a substantially right angle; and said second end is a substantially triangular strip that extends from said top portion of said conductive plate at a substantially right angle.

18. The method of claim 1 wherein said antenna is adapted to operate from 30 to 300 MHz.

19. The method of claim 1 wherein said antenna is a half-loop antenna.

20. The method of claim 1 further comprising the step of placing said second end in electrical communication with said antenna feed.

21. The method of claim 20 wherein said antenna feed is an N-type antenna feed.

* * * * *